United States Patent [19]

Giallombardo

[11] Patent Number: 4,557,701

[45] Date of Patent: Dec. 10, 1985

[54] TUMBLER TOY

[76] Inventor: John M. Giallombardo, 570 Pendale St., Staten Island, N.Y. 10306

[21] Appl. No.: 582,383

[22] Filed: Feb. 22, 1984

[51] Int. Cl.[4] ..... A63H 29/08

[52] U.S. Cl. ..... 446/170; 273/110

[58] Field of Search ..... 446/168, 170, 173; 273/109, 110

[56] References Cited

U.S. PATENT DOCUMENTS

| | | | |
|---|---|---|---|
| 1,272,587 | 9/1934 | Fairchild | 273/109 |
| 3,005,635 | 10/1961 | Greene | 273/109 |
| 3,118,676 | 1/1964 | Louis | 273/109 |
| 3,304,090 | 2/1967 | Morris | 446/170 |
| 3,416,801 | 12/1968 | McKeown | 446/170 |

*Primary Examiner*—Robert E. Bagwill
*Assistant Examiner*—Daniel Nolan
*Attorney, Agent, or Firm*—Richard L. Miller

[57] ABSTRACT

A tumbler toy containing typically four ramp surfaces placed radially at a fixed angle. When a player rotates the toy, all of the ramp surfaces rotate simultaneously and a ball can be made to roll along the ramp surface until it encounters an opening in the ramp surface. When the ball descends through this opening it is deflected by a guide placed along the ramp surface. With experience and practice a player can rotate the tumbler toy either clockwise or counterclockwise and keep the ball moving from ramp surface to ramp surface indefinitely.

4 Claims, 3 Drawing Figures

TUMBLER TOY

BACKGROUND OF THE INVENTION

The present invention relates generally to amusement toys and more specifically to toys which require manual dexterity and coordination. A number of toys balls have been invented including a roll and catch toy (U.S. Pat. No. 3,586,329), an orbiting toy (U.S. Pat. No. 3,315,963) and a rolling element on moving surface toy (U.S. Pat. No. 3,137,506), however, none of the aforementioned inventions is similar to the instant invention and none of these require or develop the skill and manual dexterity of the instant invention.

SUMMARY OF THE INVENTION

It is, therefore, a primary purpose of the present invention to provide a tumbler toy which contains typically four ramp surfaces which provide part of the pathway for a moving ball.

Another purpose is to provide a challenging tumbler toy in which the ramp surfaces, which extend in a fixed radial configuration, may be rotated by the player. Each ramp surface has an opening in it so that when the toy is rotated the ball will fall through the opening in the ramp surface and descend to the next ramp surface.

Another purpose is to provide a tumbler toy in which the ramp surfaces are also equipped with guides so that a ball descending from one ramp surface to another may be redirected so as to travel along the length of the ramp surface.

A yet further object is to provide a tumbler toy which may be rotated by the player in either the clockwise or counterclockwise direction and if rotated with skill and coordination cause the ball to continue traveling indefinitely along a pathway defined by the ramp surfaces, the openings and the guides.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 2 is a top elevational view there of.

DETAILED DESCRIPTION OF THE PREFERRED EMBODIMENT

Figure 1:
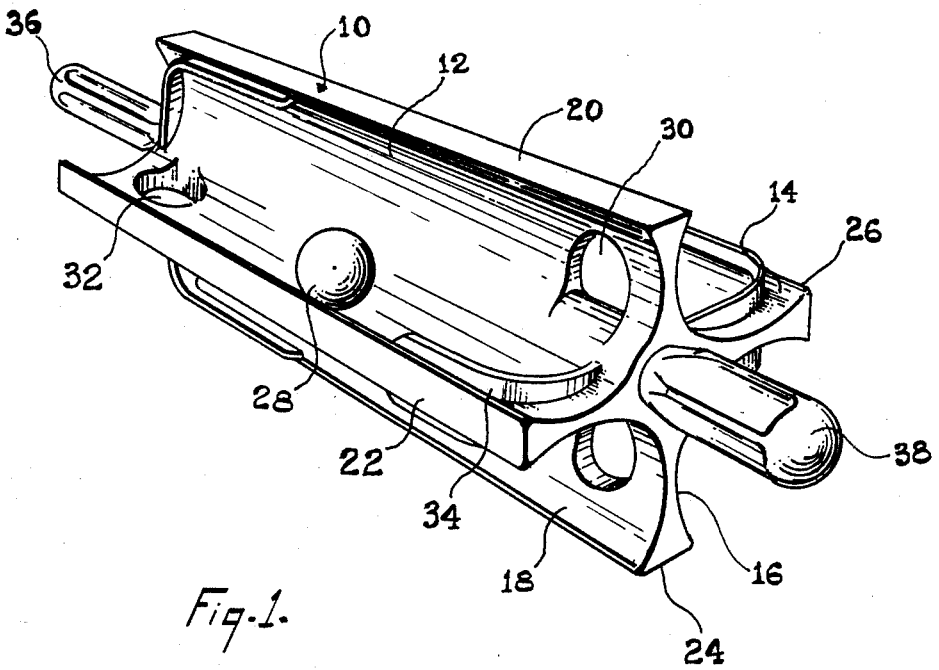
FIG. 1 is a perspective view of the invention.

In FIG. 1 the invention 10 may be clearly seen to contain four ramp surfaces 12, 14, 16 and 18. A ball 28 has just descended from typical opening 30 and, having been deflected by typical guide 34 is moving along ramp surface 18 away from the viewer. Between the edge of each of ramp surfaces 12, 14, 16 and 18 are flared edges 20, 22, 24 and 26 to create double concave surfaces which aid ball 28 in maintaining a path along the ramp surfaces. Handles 36 and 38 are rotated either clockwise or counterclockwise by the player in a coordinated manner so as to keep ball 28 from leaving any of the ramp surfaces. This may continue indefinitely. The relative difficulty of the game may be changed. For example, at manufacture increasing the width of the flare between ramp surfaces will ease the game by decreasing the likelihood of having a ball leave the ramp surfaces. Likewise, increasing the height of the guides, such as typical guide 34, will also decrease the probability of such a ball exiting the toy.

Figure 2:
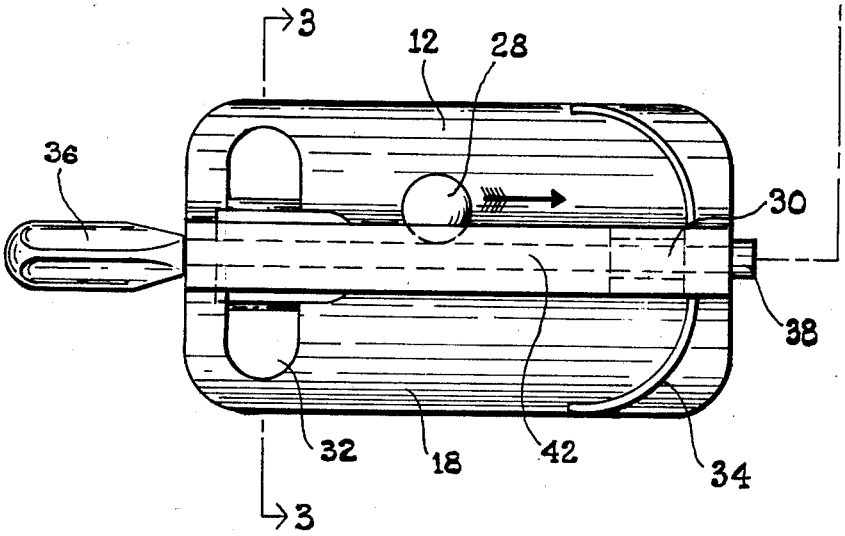
Figure 3:
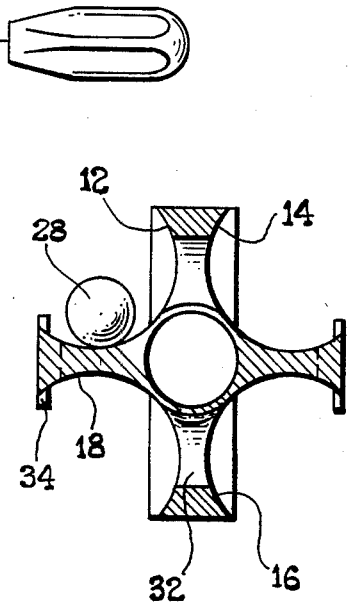
FIG. 3 is a cross sectional view taken on line 3—3 of FIG. 2.

In FIG. 2, it may be seen that handle 36 is an integral part of the toy while handle 38 is discreet but attached by the mating of handle mounting plug 38 and handle socket 40. It may also be seen that the toy may be constructed out of one molded piece with a hollow core 42.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A tumbler toy, comprising in combination:

(a) four ramp surfaces in a radial configuration around a central core having an elongated axis, wherein said ramp surfaces are located at a ninety degree angle with respect to each other about said core, each curved wall section having an opening of such dimension as to allow a ball to pass through at only one end thereof, with the openings located so that each ramp surface has the openings at diametric opposing ends thereof, said openings being positioned on the curved wall sections so that each opening is spaced along its respective common axial line when the respective curved wall section is in an upward verticle position;

(b) a guide affixed to each of said ramp surfaces whereby said ball falling through any of said openings may be redirected in its path of travel so as to redirect any radial motion, which would tend to dislodge said ball from said tumbler toy, into an axial motion, thereby creating a possibility of manipulating the invention so as to cause said ball to fall through another said opening in another said ramp surface; and, (c) means for rotating said multiplicity of ramp surfaces axially and radially.

2. A tumbler toy, as recited in claim 1, wherein said guide comprises a curved plane located on the end of each of said ramp surfaces opposite said openings such that if said tumbler toy is rotated axially in any direction, the motion of the ball incident from any opening has a likelihood of being redirected.

3. A tumbler toy, as recited in claim 1, wherein said means for rotating said multiplicity of ramp surfaces axially comprises two handles placed axially at both ends of the invention so that a user may grasp one handle in each hand and cause said ramp surfaces to rotate while skillfully manipulating the rate of rotation in order to prevent said ball from becoming dislodged.

4. A tumbler toy, as recited in claim 3, wherein one of said handles is an integral part of the invention while the other handle is detachable.

* * * * *